US005412165A

United States Patent [19]

Malone et al.

[11] Patent Number: 5,412,165

[45] Date of Patent: May 2, 1995

[54] MULTIPLE SWITCH ASSEMBLY WITH DETENTED ROCKER ACTUATOR

[75] Inventors: Peter G. Malone, Park Ridge; Louis C. Lai, Brookfield, both of Ill.

[73] Assignee: Eaton Corporation, Cleveland, Ohio

[21] Appl. No.: 155,058

[22] Filed: Nov. 19, 1993

[51] Int. Cl.[6] ..... H01H 3/00; H01H 9/00; H01H 13/00

[52] U.S. Cl. ..... 200/5 R; 200/17 R; 200/339

[58] Field of Search ..... 74/527, 531; 200/4, 200/5 R, 5 A, 512–517, 17 R–18, 314, 315, 339, 553, 557

[56] References Cited

U.S. PATENT DOCUMENTS

| | | | |
|---|---|---|---|
| 3,403,236 | 9/1968 | Zoludow | 200/339 X |
| 3,403,237 | 9/1968 | Wysong | 200/339 X |
| 3,519,776 | 7/1970 | Slater | 200/339 X |
| 3,843,852 | 10/1974 | Lockard | 200/16 D |
| 4,029,925 | 6/1977 | Biske | 200/339 |
| 4,117,280 | 9/1978 | Feaster | 200/6 B |
| 4,423,300 | 12/1983 | Chesemore et al. | 200/339 X |
| 4,698,464 | 10/1987 | Tanaka et al. | 200/5 R |
| 4,861,950 | 8/1989 | Yanai et al. | 200/5 R |
| 5,115,108 | 5/1992 | Ogawa et al. | 200/5 A X |

*Primary Examiner*—J. R. Scott
*Attorney, Agent, or Firm*—Roger A. Johnston

[57] ABSTRACT

A switch assembly of the type having a rocker actuator user rotatable in opposite directions from a neutral position for alternate actuation of individual switches on opposite sides of the rocker each having a moveable actuator member movement of which by the rocker effects actuation of the switches. The rocker has a plurality of arcuately spaced recesses which are resiliently engaged to detent the rocker in a neutral and an actuated position. In one embodiment, the recesses engage a resilient wire beam spring extending parallel to the rocker axis. In another embodiment, the recesses are formed on a portion of the rocker which resiliently deflects to permit engagement and disengagement with a stationary pivot surface. In another embodiment, recesses in the rocker are engaged by a detent surface provided on a stationary resiliently deflectable beam extending at right angles to the rocker axis.

13 Claims, 3 Drawing Sheets

MULTIPLE SWITCH ASSEMBLY WITH DETENTED ROCKER ACTUATOR

BACKGROUND OF THE INVENTION

The present invention relates to switches of the type having a user manipulated actuator with a central unactuated position and an actuated position on either side of the neutral or unactuated position. Switches of this type are usually known as rocker switches, due to the rotational movement of the user manipulated actuator from the neutral or unactuated to either of the actuated positions. Where the user manipulated actuator has a portion extending outwardly therefrom as a projection, switches are typically known as paddle type rocker switches.

Switches of the above-mentioned type have found widespread usage in automotive applications where it is desired to provide the user with readily discernible tactile feedback of the state of the switch actuator in order that the vehicle operator may manually locate the switch and effect the desired movement thereof without visual distraction from the primary function of vehicle operation.

In vehicle accessory control switch applications, it is often desirable to provide an indication of a switch neutral or unactuated position; and, in some cases it may be desirable to provide a detenting of the movement of the actuator to provide the user with a discernable indication of the neutral or unactuated position, and particularly in applications where the switch actuator is movable in opposite directions of rotation. Where a switch is operated by bidirectional rotation of an actuator member such as a rocker, for actuating a plurality of stationary individual switching mechanisms, it has been difficult to provide a tactiley discernable way or means of indicating the neutral or unactuated position of the switch without substantially altering the effort required to actuate or "feel" required to actuate the switch in either of the opposing directions of movement. In rocker type switches employed for automotive accessory controls, and particularly such switches manufactured in high volume, it has proven extremely difficult to incorporate a positively discernable neutral position indication in a switch without substantially increasing the cost of the switch to the extent which would render the switch non-competitive in the marketplace for automotive applications. Thus, it has long been desired to provide a way or means of detenting a rocker-actuated switch where the switch is intended to be operated in opposite directions from a central or neutral position, and to provide such an indication or feel of the neutral position in a manner which is reliable and low in cost in high volume mass production.

SUMMARY OF THE INVENTION

The present invention provides a switch having a user movable rocker member which may be rotated in either of two opposite directions for effecting actuation of a selected one of plural individual switching mechanisms or movement of a member between an operating and reset position. The rocker actuator member of the present switch assembly is detented to a central or neutral position in which none of the electrical switching mechanisms is actuated; and, the detenting is accomplished by resilient engagement of recesses in the rocker actuator member. The neutral position is tactiley discernible by the user by a noticeable increase in the force required to move the switch in either direction from the neutral position. In one embodiment of the invention, an arcuate surface on the rocker actuator member has recesses formed therein which engage a wire beam spring disposed on the switch housing so as to resiliently engage the recesses. Upon attempted user movement of the rocker actuator, an increased force is required to initiate movement of the rocker actuator from the recess in order to cause the beam spring to be cammed or ramped out of the recess and to slide along the arcuate surface during actuation. In the preferred practice, an additional recess is provided in both of the fully actuated position of the arcuate surface to permit detenting of the switch in the actuated position in either direction of rotation of the rocker from the neutral position.

In another embodiment, the arcuate surface of the rocker actuator member has recesses formed therein in the neutral and actuated positions; and, the arcuate surface comprises a resilient portion of the rocker member which acts to provide resilient or spring engagement of the rocker actuator recesses with a rigid stationary detent surface provided on the housing. In another embodiment, the arcuate surface of the rocker actuator has detenting recesses for the neutral and actuated positions which engage a detent surface formed on a resiliently deflectable portion of the housing.

DETAILED DESCRIPTION

Figure 1:
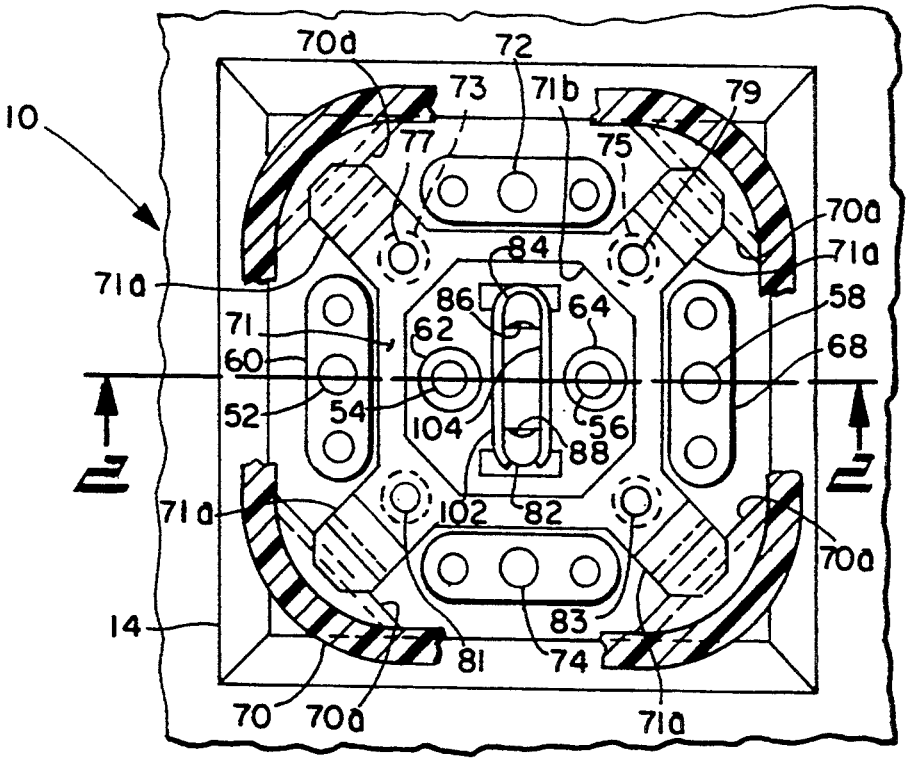
FIG. 1 is a top view of the switch assembly of the present invention, with portions of the case removed.
Figure 2:
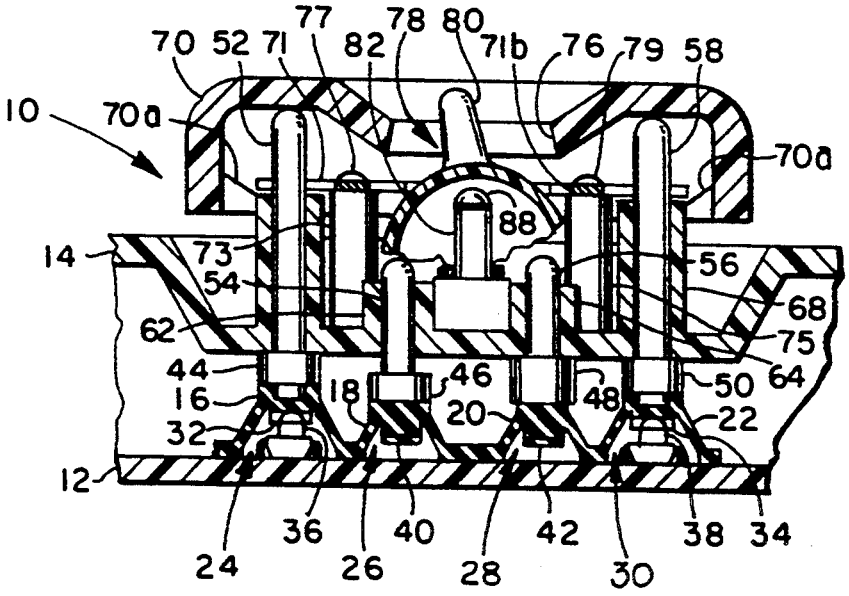
FIG. 2 is a section view taken along section-indicating lines 2—2 of FIG. 1.

Referring to FIGS. 1 and 2, a switch assembly employing the present invention is indicated generally at 10 as having a housing means which includes a base 12 and a cover 14. Base 12 has a plurality of flexible sealing membranes or domes denoted by reference numerals 16,18,20,22 attached to the interior of the base 12. In the presently preferred practice, the membranes are formed of elastomeric material and, if desired, may be integrally formed as by molding in a single sheet of material.

Each of the membranes or domes has an electrical switching mechanism or control member movable between an operating an reset position provided on the interior or underneath side thereof, as indicated generally by reference numerals 24,26,28,30. The switches disposed in the extreme leftward and rightward position in FIG. 2 denoted by reference numerals 24,30 each employ an actuator pad or control member denoted, respectively, by reference numerals 32,34 disposed on the undersurface of the membrane, and which are located for actuating a microswitch disposed thereunder, as denoted by reference numerals 36,38 and mounted on base 12 as, for example, on a printed circuit (not shown). The centrally located switches denoted by reference numerals 26,28 disposed intermediate switches 24,30, each have a conductive pad or shorting bar denoted, respectively, by reference numerals 40,42 provided on the underside of the membrane 18,20. Each of the conductive pads 40,42 is disposed to make contact with, in the manner of a shorting bar, separate conductive strips (not shown) provided on the upper surface of base 12 as, for example, by printed circuit techniques, as is well known in the art.

Each of the membranes 16,18,20,22 has disposed centrally directly thereabove the head portion indicated, respectively, by reference numerals 44,46,48,50 of a plunger denoted, respectively, by reference numerals 52,54,56,58. Each of the plungers is guided for vertical sliding movement in the housing cover 14, respectively, by a bore formed, respectively, in guide-towers 60,62,64,68.

Plungers 52,58 extend vertically upwardly and exteriorly of the cover 14, and are actuated by the user depressing an actuator bar or frame 70. It will be understood that an additional pair of plungers denoted by reference numerals 72,74 in FIG. 1 are disposed in quadrature with respect to plungers 52,58 for similar actuation by frame 70, with the actuators 72,74 not being visible in FIG. 2. Actuator bar 70 has a central aperture 76 formed therein, through which extends a selector or paddle portion 80 of a rocker actuator member indicated generally at 78 for manual user contact. A retainer plate 71 is mounted on stanchions 66, 69, 73, 75, two of which are shown in FIG. 2 denoted 73, 75; and, plate 71 is riveted thereon as denoted by reference numerals 77, 79, 81, 83 in FIGS. 1 and 2. Plate 71 has four outriggers or comer tabs which engage comer ramp 70*a* in actuator bar 70 for retaining the actuator bar. Bar 70 has a central clearance hole 71*b* through which rocker 78 extends. The rocker 78 is supported by a pair of stanchions 82,84 disposed in spaced-parallel relationship on the cover 14, and which are disposed intermediate the towers 62,64, which have portions thereof denoted by reference numerals 86,88 pivotally engaging correspondingly shaped surfaces on the rocker 78.

Figure 3:
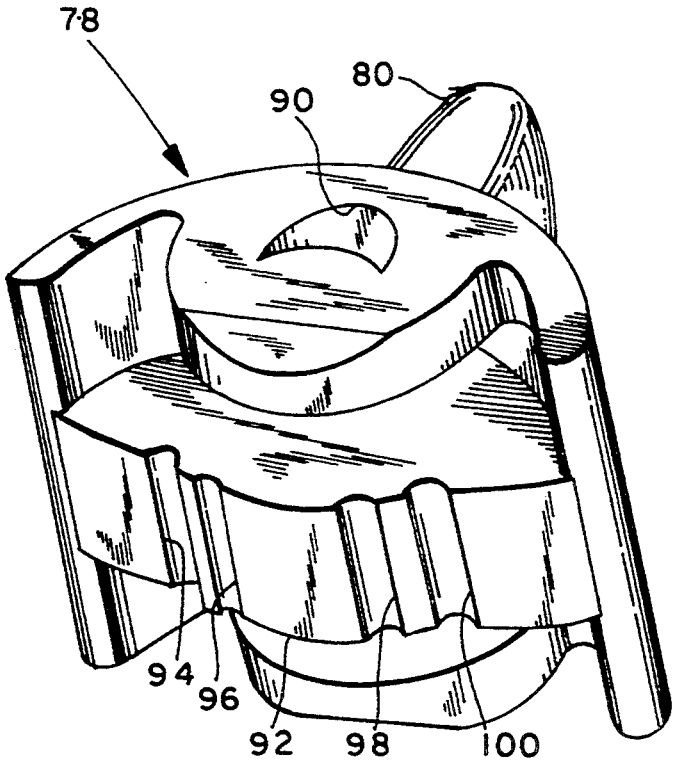
FIG. 3 is an axonometric view of the rocker member illustrated in the embodiment of FIG. 2.
Figure 4:
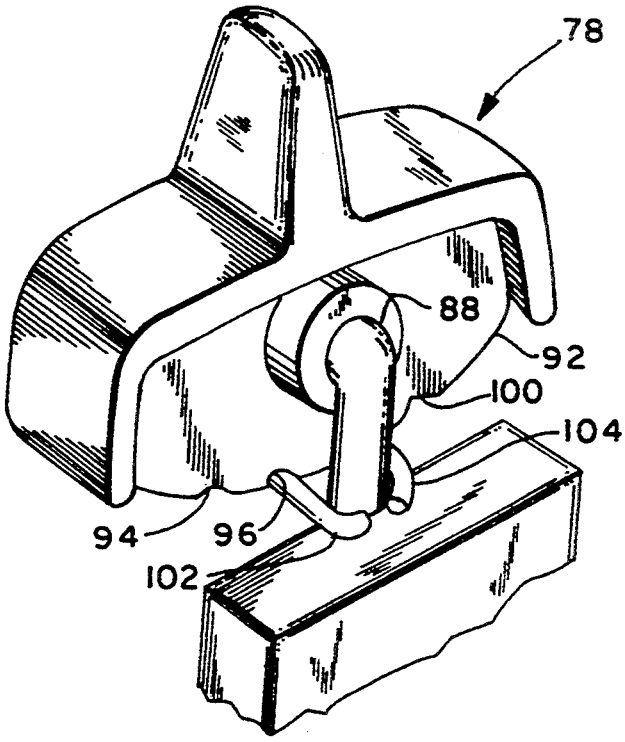
FIG. 4 is an axonometric view of portions of the rocker member of FIG. 3 detented by a beam spring.

Referring to FIGS. 1 through 4, the rocker 78 is illustrated in axonometric view; and, the pivot surfaces 90 engageable with the surfaces 88 on stanchion 82 are illustrated in FIG. 3, it being understood that these portions are omitted in FIG. 4.

The rocker member 78 has provided on the opposite side of pivot surfaces 90 from the paddle 80 an arcuately-shaped surface denoted by reference numeral 92. A plurality of arcuately spaced generally parallel recesses denoted by reference numerals 94,96,98,100 are formed in the surface 92; and, each extends transversely of the arcuate surface or in a direction generally parallel to the axis of rotation of member 78 about the stanchion pivots 86,88.

Referring to FIGS. 1, 2, and 4, a detent means comprising a pair of resiliently deflectable beam springs denoted by reference numerals 102, 104 are disposed at the base of stanchions 82,84, and extending therebetween and registered and supported thereon. In the presently preferred practice, the beam springs 102, 104 are formed integrally in a unitary piece of resilient spring wire, and are configured to engage the recesses 96,98 of rocker 78 simultaneously in the neutral or centered position of the rocker 78, as illustrated in FIG. 4.

Upon user contact with paddle 80 and application of sufficient force laterally thereto, or on the right side thereof with respect to FIG. 2, the recesses 96,98 are caused to cam or ramp up against the beam springs 102, 104. The springs, as a result of the camming or ramp up, are deflected laterally; and, the rocker 78 is moved in an anti-clockwise direction about the pivot surfaces 88,84 to move the recesses 96,98 away from the beam springs 102,104 to the position shown in FIG. 2. It will be understood that further movement of the rocker 78 in an anti-clockwise direction from the position shown in FIG. 2, will result in the beam springs 102, 104 sliding along the arcuate surface 92 until a position is reached wherein the beam spring 102 engages recess 94 and beam spring 104 engages recess 96 to detent the rocker in the leftward or anti-clockwise actuated position. It will further be understood that in such actuated position with beam spring 102 engaging recess 94, the rocker member 78 is operative to push plunger 54 downwardly to effect closure or actuation of the switch 26.

It will be understood that upon similar movement of the paddle 80 in a clockwise direction from the neutral or unactuated position, beam spring 104 slides along surface 92 and engages recess 100, and causes the rocker 78 to effect downward movement of plunger 56 and actuation of switch 28.

Upon user application of a sufficient force or torque in a reverse direction from the actuated positions (i.e., engagement of either of the recesses 94,100) for either of switches 26,28, the rocker is returned to the neutral position wherein beam spring 102 engages recess 96 and beam spring 104 engages recess 98 to return both of the switches 26,28 to the unactuated position. In the presently preferred practice, the switch assembly 10 of the present invention has found particular application for control of automotive rear-view mirror adjustment motors wherein the switches 26,28 are connected to circuits for selecting control of either the left-hand or the right-hand mirror adjustment motors. It will be understood that in an automotive mirror control application, the frame 70 is then movable for effecting actuation of a plurality of switches, such as the switches 24,38 to provide remote control of the selected mirror adjustment motors.

Figure 5:
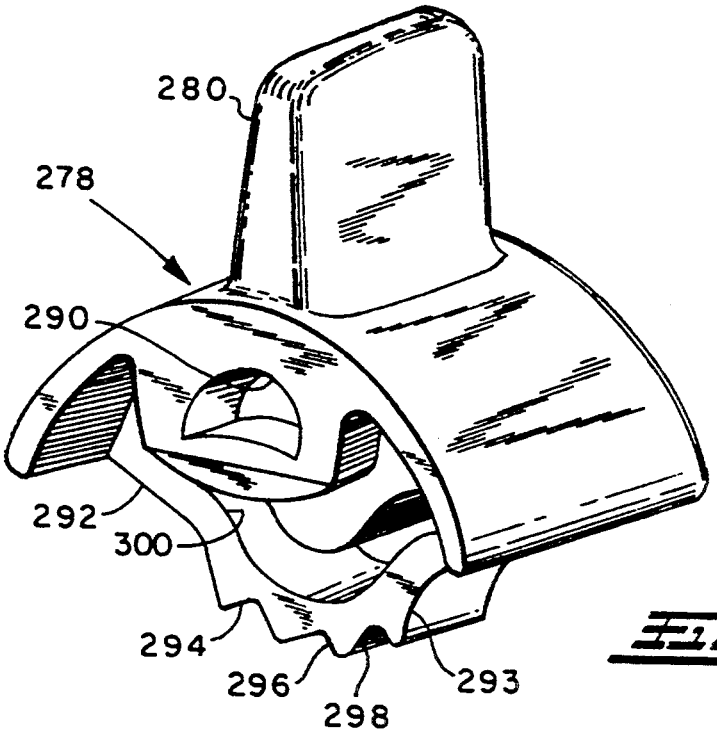
FIG. 5 is a view similar to FIG. 3, of an alternate embodiment of the rocker actuator of the present invention.
Figure 6:
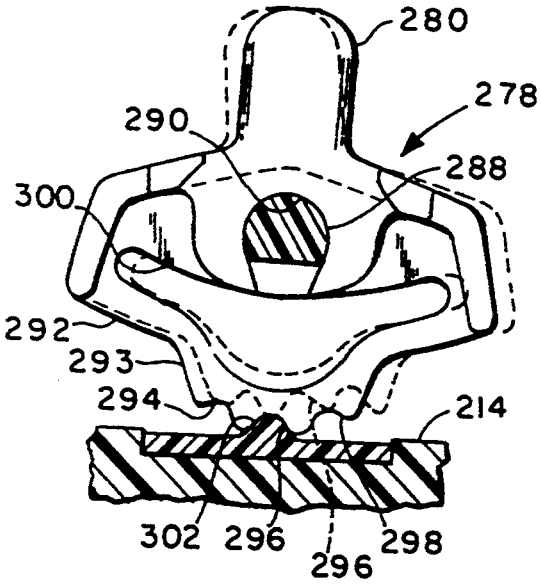
FIG. 6 is a portion of a section view of an embodiment of the invention employing the rocker member of FIG. 5.

Referring to FIGS. 5 and 6, an alternate embodiment of the rocker is illustrated generally at 278 and has a paddle 280 similar to the paddle 80 on the rocker 78 with oppositely disposed pivot surfaces, one of which is visible in FIG. 5 and 6, and denoted by references numeral 290. The pivot surfaces such as 290 are engaged with corresponding pivot surfaces such as 288 provided on the switch housing cover 214 illustrated in FIG. 6. The rocker 278 has an arcuate surface 292 provided on the lower side thereof oppositely disposed about the pivot surface 290 from paddle 280. Arcuate surface 292 has formed thereon a downwardly-extending portion 293, which has formed thereon in generally arcuately-spaced transversely extending parallel arrangement a plurality of recesses 294,296,298 with the recess 296 being centered in alignment with respect to paddle 280 and pivot surface 290. An arcuately shaped slot 300 is formed in the lower portion of rocker 278 spaced adjacent from surface 292 by a predetermined amount; and, the slot 300 renders the adjacent portion of rocker 278 in portion 293 defining surface 292 resiliently flexible or deflectable in a direction toward the pivot surface 290.

Referring to FIG. 6, the rocker 278 is shown in the neutral position in solid outline with recess 296 resiliently engaging the raised detent surface 302 provided on the housing cover 214, which detent surface is centered vertically with respect to pivot surface 290 to provide a positive neutral or center position resilient detenting action for the rocker 278. Upon user application of a force to the right side of paddle 280 sufficient to cause camming of the arcuate surface 292 against detent 302 and resilient deflection of surface 292, detent 302 slides along surface 292 such that recess 296 is moved in an anticlockwise direction as shown in dashed outline in FIG. 6. It will be understood that further movement of the paddle 280 in an anti-clockwise direction from the position shown in dashed outline in FIG. 6 will result again in camming against the detent, which will result in the recess 294 resiliently engaging detent surface 302, thereby frictionally detenting the rocker 278 in the actuated position for actuating switch 26. It will further be understood that upon user actuation of a sufficient force to the left side of paddle 280, the recess 294 cams against detent 302, resiliently deflecting the arcuate portion 292, causing the rocker 278 to be returned to the neutral position, wherein recess 296 engages detent 302. It will further be understood that continued application of sufficient force to the left side of paddle 280 will result in camming of the recess 296 over detent 302 by resilient deflection of portion 292 and rotational movement of rocker 278 such that recess 293 engages detent 302, wherein switch 28 is actuated.

Figure 7:
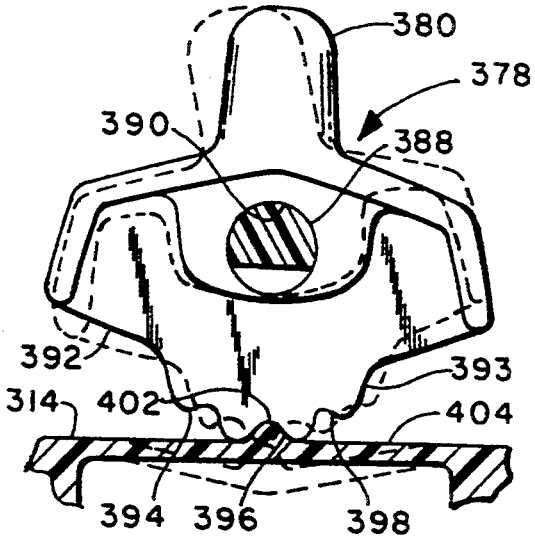
FIG. 7 is a view similar to FIG. 6, of another embodiment of the invention.

Referring to FIG. 7, another embodiment of the invention is illustrated, wherein the rocker actuator is indicated generally at 378, and has a user contactable paddle portion 380 wherein the rocker 378 is indicated in the neutral position in solid outline in FIG. 7, and in a counter-clockwise rotated switch actuated position in dashed outline. The rocker 378 has a central pivot surface 390 which is received over, and slidably registered on pivot surface 388 of the stanchion provided on cover 314 in a manner similar to the embodiment of FIG. 4. The rocker 378 has an arcuate surface 392 formed on the lower side thereof, disposed oppositely of the pivot surface 388 from the user paddle 380. The arcuate surface 392 has a downwardly-projecting portion in the central region thereof, denoted by reference numeral 393, which has a central or neutral position recess 396 with left and right switch actuation position recesses spaced on opposite sides of recess 396 denoted, respectively, by reference numerals 394,398. The switch housing 314 of the embodiment of FIG. 7 has a detent surface denoted by reference numeral 402 provided on a resiliently deflectable beam portion 404; and, the detent surface 402 is illustrated in solid outline in FIG. 7 in a position engaging the neutral recess 396 in rocker 378.

Upon rotation by the user of the paddle 380 in a counter-clockwise direction to the position shown in dashed outline in FIG. 7, the detent 402 and resilient portion 404 are deflected downwardly to position shown in dashed outline by the camming or ramp action of the recess 396 and sliding of detent 402 on surface 392 to effect rotary movement of the rocker 378. The action of the embodiment of FIG. 7 is otherwise similar to the action of the embodiment of FIG. 6.

The present invention thus provides a simple, convenient, and relatively low-cost way or means of providing tactiley discernable resilient detenting of a bi-directional rocker actuated switch in the unactuated and actuated position.

Although the invention has hereinabove been described with respect to the illustrated embodiments, it will be understood that the invention is capable of modification and variation, and is limited only by the following claims.

We claim:

1. A switch assembly comprising:

(a) housing means;

(b) a first and second switching means each having a contact member, movable between a first and a second position said switching means each operable by said movement to effect a switching function;

(c) a rocker member mounted for rotational movement in a clockwise and anti-clockwise direction on said base means and formed of resilient electrically non-conductive material and having a user contactable position extending from said housing means for manual actuation thereof and other portions thereof defining pivot surfaces engaging corresponding surfaces of said housing means and a certain depending portion defining detent surfaces thereon;

(d) at least one beam spring disposed in generally spaced parallel arrangement and extending at generally right angles to the direction of said pivotal movement, said at least one beam spring resiliently engaging said detent surface to provide resilient detenting of said rocker member upon user movement thereof; and, (e) a plurality of actuators operably responsive upon movement of said rocker in said directions to alternately effect said movement of said first and second switching means contact members between said first and second positions.

2. The assembly defined in claim 1, wherein said at least one beam spring are formed of wire having a circular configuration in transverse section.

3. The assembly defined in claim 1, wherein said at least one beam spring comprises two beam springs formed integrally from a single wire having a generally U-shaped configuration.

4. The assembly defined in claim 1, wherein said rocker member is formed integrally of thermoplastic material.

5. The assembly defined in claim 1, wherein said certain depending portions of said rocker member has a generally arcuately shaped configuration.

6. The assembly defined in claim 1, wherein said plurality of actuators comprises individual movable members mounted for movement on said housing means, each responsive to said pivotal movement of said rocker member in one of said opposite directions of movement.

7. The assembly defined in claim 1, wherein said at least one beam spring is formed of thermoplastic polymer.

8. The assembly defined in claim 1, wherein said at least one beam spring extends in a direction generally perpendicular to the axis of rotation of said rocker.

9. A switch assembly comprising:

(a) housing means;

(b) a rocker member mounted for rotational movement in a clockwise and anti-clockwise direction on said housing means and having integrally formed therewith a user-movable portion extending externally of said housing means an including another portion disposed interiorly of said housing means on the opposite side of said pivotal mount from said user-movable portion, said another portion defining a plurality of detent surfaces disposed in arcuately spaced arrangement;

(c) a first and second switching means each having a contact member mounted on said housing means on opposite sides of said rocker pivotal mount and operable for movement between a first position and a second position said switching means each operable by said movement to effect a switching function; and, (d) detent means mounted on said housing means and operable to effect resiliently releasable engagement of said detent surfaces at a neutral or centered position and upon said rotational movement of said rocker in either of said opposite directions at a position causing said movement of, respectively, one of said switching or control members; wherein, said rocker member is operative upon user movement in said directions to alternately effect said movement of said first and second switching means contact members.

10. The switch assembly defined in claim 9, wherein said detent means comprises a beam spring extending in a direction generally parallel with respect to the axis of rotation of said rocker.

11. The switch assembly defined in claim 9, wherein said detent means comprises a beam spring formed of wire and having a generally U-shaped configuration.

12. The switch assembly defined in claim 9, wherein said rocker member includes a generally arcuately shaped resiliently deformable portion defining said detent surfaces.

13. The switch assembly defined in claim 9, further comprising a plurality of individual actuator members mounted for movement on said housing means, each responsive to said rotational movement of said rocker member in one of said clockwise and anti-clockwise directions.

* * * * *